United States Patent [19]

Hammer et al.

[11] Patent Number: 5,022,292

[45] Date of Patent: Jun. 11, 1991

[54] TOOL FOR INSTALLATION OF CLIP

[75] Inventors: Russell C. Hammer, Milford; Gregory J. Silage, Clemens; Casimir P. Pietron, Royal Oak, all of Mich.

[73] Assignee: Chrysler Corporation, Highland Park, Mich.

[21] Appl. No.: 503,577

[22] Filed: Apr. 3, 1990

[51] Int. Cl.[5] ..... B25B 7/02

[52] U.S. Cl. ..... 81/426; 29/243.56; 29/268

[58] Field of Search ..... 29/243.5, 243.56, 248, 29/268, 275; 81/418–420, 424.5, 426, 426.5

[56] References Cited

U.S. PATENT DOCUMENTS 4,149,435 4/1979 Smith ..... 81/426

4,697,483 10/1987 Rodgers ..... 81/426

*Primary Examiner*—J. J. Hartman

*Attorney, Agent, or Firm*—Edward P. Barthel

[57] ABSTRACT

A pliers-type hand tool for assembling a cable fitting to a manual operable gearshift mechanism by use of a spring metal clip retainer.

1 Claim, 2 Drawing Sheets

TOOL FOR INSTALLATION OF CLIP

BACKGROUND OF THE INVENTION

This invention relates to hand tools and more particularly to a pliers-like hand tool for assembling a spring clip on a cable retainer for use during assembly line installation of a vehicle automatic transmission cable shifter mechanism.

The U.S. Pat. No. 4,693,135 issued Sept. 15, 1987 to LaRocca et al. discloses a vehicle shifter support wall portion provided with openings receiving cable guide components. One opening has a slot receiving and supporting a U-shaped grommet clip including a cable guide component having a sliding fit with upwardly extending legs of the clip whereby the guide component is movable upwardly and downwardly relative to the clip.

SUMMARY OF THE INVENTION

It is an object of the present invention to provide a pliers-like hand tool for attaching a spring steel clip to retain a cable conduit fitting on a gear shift support base.

It is another object of the present invention to provide a pliers-like hand tool as set forth above wherein the hand tool is simple to use and easy to adjust.

To accomplish these objectives, a pliers-like hand tool is provided having first and second lever members each having handle portions and a jaw portion. The lever members cross over each other at a pivotal connection and are operative to open and close the jaw portions. The first lever member jaw is in the form of a U-shaped lower jaw providing a pair of horizontally disposed prongs defining a notch therebetween. Each of the prongs has an arcuate depression adapted to receive an associated cylindrical portion of the cable conduit fitting with the notch straddling a cable slotted flange of the gearshift mounting base. The second lever member upper jaw provides a die member having a right-angled cut-out defining a horizontal shoulder portion and a coextensive flank portion.

A U-shaped sheet metal spring clip comprises a generally planar base defining pair of spaced apart legs forming a central half-round opening. The upper portion of the base is bent to form a transverse forwardly projecting rib. The clip prongs are initially press fitted about a circumferential groove of the conduit fitting defined intermediate a conduit integral raised washer portion and the gear shift slotted flange. With the jaws being fully opened the lower jaw prong depressions receive their associated conduit fitting portions while upper jaw die cut-out is moved downward to seat the clip bent rib. Upon the jaws being closed the clip central opening is resiliently press fitted on the conduit so as to retain the fitting in fixed relation on the gear shift slotted flange.

BRIEF DESCRIPTION OF THE DRAWINGS

These and other objects, features and advantages of the present invention will appear from the following written description and the accompanying drawings in which.

DETAILED DESCRIPTION OF THE PREFERRED EMBODIMENT

Figure 1:
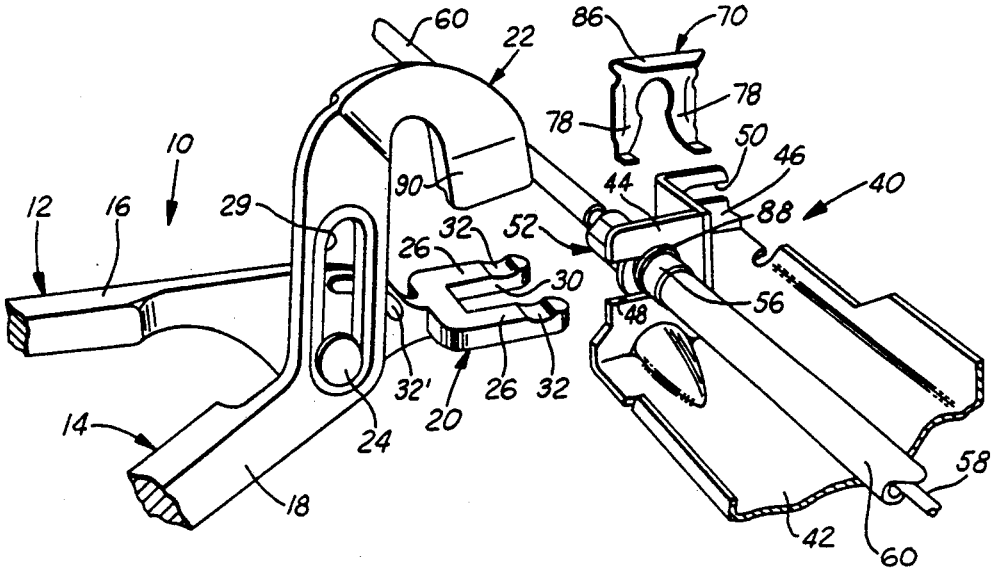
FIG. 1 is a fragmentary exploded perspective view of the hand tool of the invention illustrating the initial orientation of the tool in relation to the spring clip, cable connector, and the shifter support base.
Figure 3:
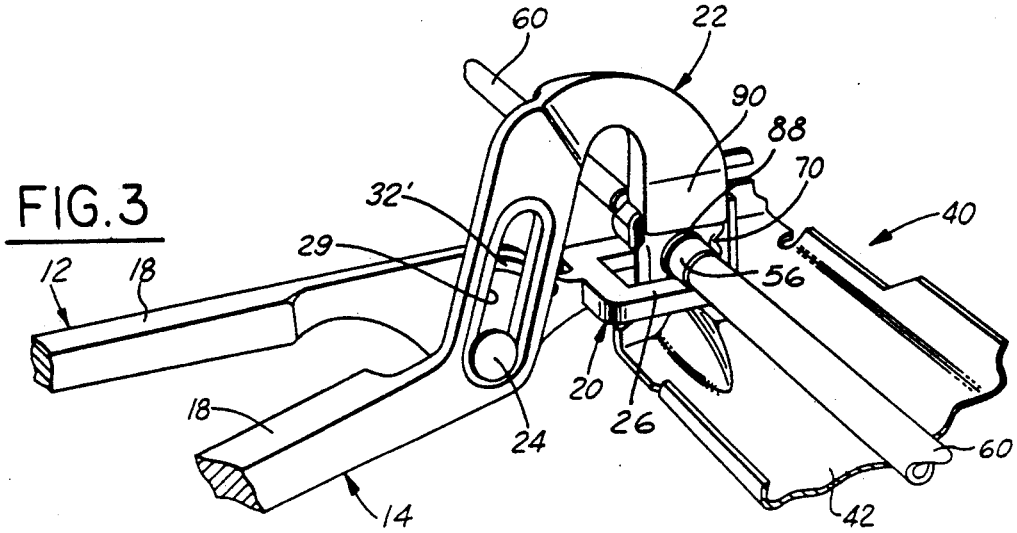
FIG. 3 is a view similar to FIG. 2 illustrating the position of the hand tool following the attachment of the spring clip on the cable connector.

Turning now to the drawings and more particularly to FIG. 1, an illustrative embodiment of a pliers-like hand tool 10 of the invention is shown comprising first 12 and second 14 lever members which cross over each other at a pivotal connection. The first 12 and second 14 lever members comprise first 16 and second 18 handles connecting first 20 and second 22 jaws, respectively, through a pivot pin or shaft 24 defined by a bolt and a nut. By squeezing handles 16 and 18 together jaws 20 and 22 move toward each other from an open position of FIG. 1 to a closed attaching position of FIG. 3.

The lever members 12 and 14 are preferably of the type manufactured under the trademark "Channel Lock" by Champion DeArment Tool Co., in Meadville, Pa. and described in issued U.S. Pat. Nos. 2,592,927 and 2,640,381.

The first jaw is in the form of a U-shaped flat horizontal bifurcated lower jaw 20 having a pair of mirror image prongs 26 joined by a bight portion 27 defining a central rectangular-shaped notch 28 therebetween. It will be noted that an elongated through slot 29 is formed in run portion 30 of the upper jaw 22 to enable the pivot pin 24 to slide in the slot 29. The run portion 30 is formed with a set of matching arcuate grooves 31. The upper four grooves 31 have their entrances blocked-off by means of weld portions 31' at leading edge 31". A lowermost arcuate groove 32 is not blocked-off by a weld portion thus allowing a complementary raised arcuate ribor key 32' formed on the inner surface of lever arm 12 to be received in arcuate groove 32. This allows the pliers-like hand tool 10 to open to a single maximum setting shown in FIG. 2 and close to its FIG. 3 position.

Figure 7:
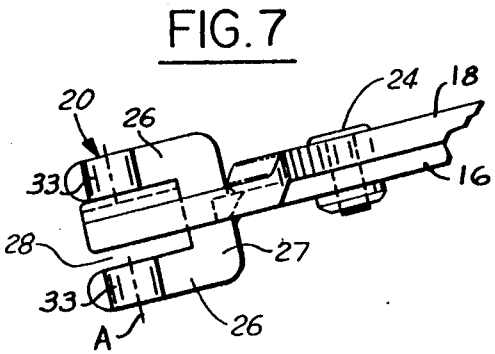
FIG. 7 is a fragmentary top elevational view of the hand tool of FIG. 5.

FIG. 1 shows each of the prongs 26 formed with an arcuate concave depression 33. It will be noted in FIG. 5 that the mirror image arcuate depressions 33 each have their center of curvature aligned on transverse axis "A" of FIG. 7. The principal axis of cable conduit portions of a conduit fitting, to be described below, are adapted for alignment on the axis "A".

Figure 5:
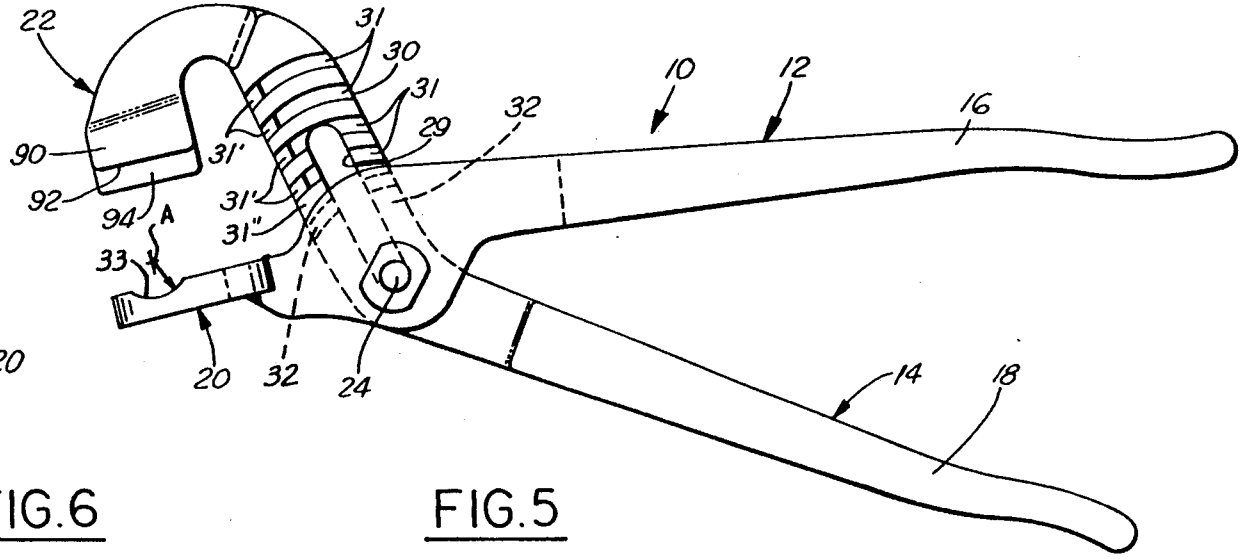
FIG. 5 is a side elevational view of the hand tool in the form of pliers in accord with he present invention.

The lower jaw 20 is depicted in spaced relationship to a vehicle cable shifter assembly generally indicated at 40. Only the forward portion of the gearshift mechanism sheet metal base 42 is shown wherein its front end is formed with a pair of vertically disposed cable mounting flanges 44 and 46 each bent upwardly from the base 42. The flanges 44 and 46 each have respective horizontally disposed open-ended slots 48 and 50 provided therein. Each of the slots 48 and 50 are adapted to receive a metal cylindrical tubular conduit fitting 52 including. The fitting 52 comprises a rearwardly projecting conduit portion 54 and a forwardly projecting conduit portion 56, aligned on a common principal axis thereof, supporting a cable core 58 within forward and aft projecting cable support tubes 60 as seen in FIG. 5.

Figure 8:
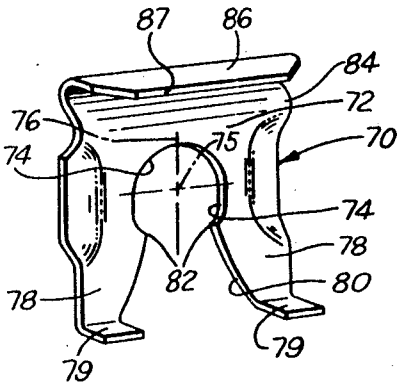
FIG. 8 is and enlarged perspective view of the spring clip installed by the hand tool of the present invention.

Referring to FIG. 8 numeral 70 illustrates a spring steel retainer clip 70 for which the hand tool of the present invention was specifically designed. The clip 70 is generally U-shaped comprising a generally planar base 72 formed with a central slotted half-round opening 74 having a center of curvature 75. The clip 70 is symmetrical about a plane of symmetry that includes construction line defining a pair of mirror image spaced apart yieldable legs 78 lying in substantially the same plane and adapted to move toward and away from each other edgewisely. The legs 78 terminate in respective right-angled foot portions 79. Each leg 78 has a convex curved lead-in edge 80 defining entrance locking gap 82. The base 72 upper portion is formed with a transverse arcuate stiffening corrugation 84 and terminates in forwardly bent rib 86 having a free linear edge 87.

Figure 2:
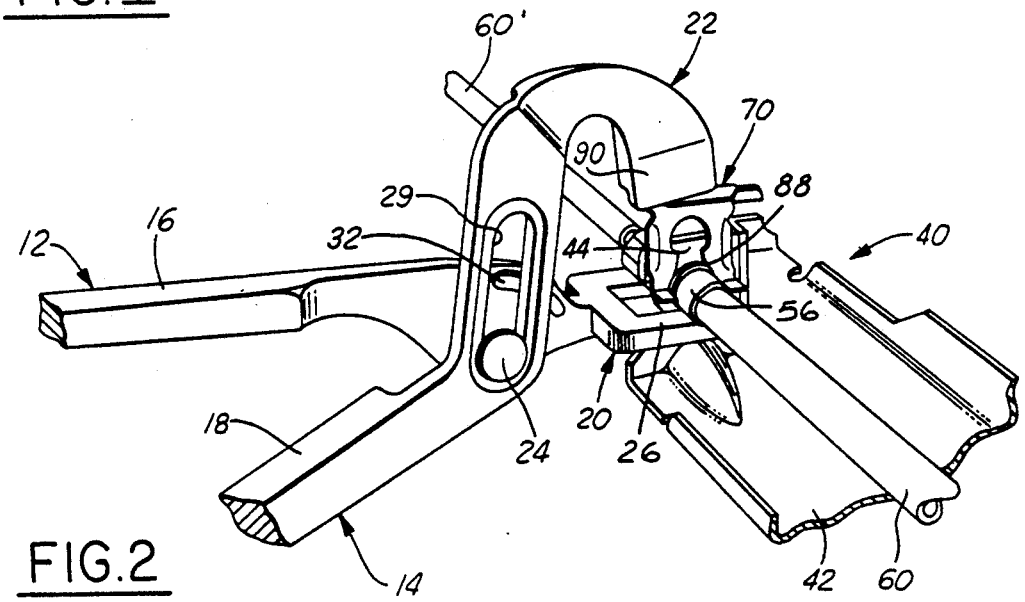
FIG. 2 is a view similar to FIG. 1 showing the manner of initial cooperation of the hand tool with the spring clip and associated cable connector.
Figure 4:
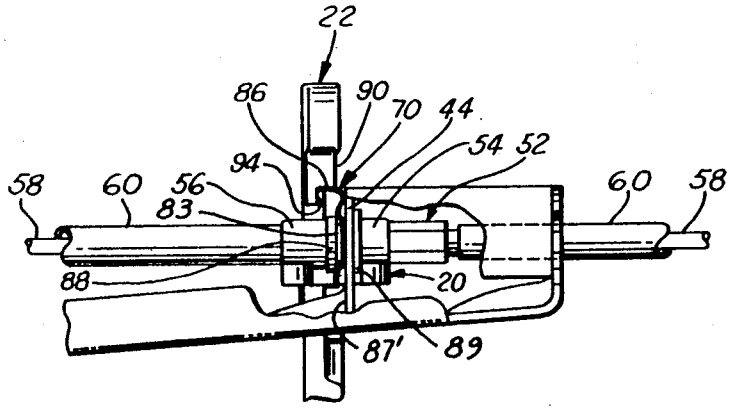
FIG. 4 is a fragmentary top elevational view with parts broken away showing the spring clip in its installed position.

With reference to FIGS. 2 and 4 it will be seen that the clip 70 is initially inserted on the cable conduit fitting 52 with its legs 78 straddling the fitting. FIG. 4 shows a clip receiving annular notch 83, defined intermediate aft face 87' of the shifter base attachment flange 44 and the opposed face of aft raised washer 88, formed on aft conduit portion 56. The clip 70 is adapted to be temporarily retained on annular notch 83 in a press fit manner by means of the clips converging lead-in edges 80. It will be noted that the forward conduit portion 54 is formed with a forward raised washer 89. With the forward raised washer 89 in flush contact with the forward face of the base attachment flange 44 the aft raised washer 83 is correctly spaced a predetermined axial distance from the flange aft face 87 to establish the axial location of notch 83 for receiving the clip 70.

Figure 6:
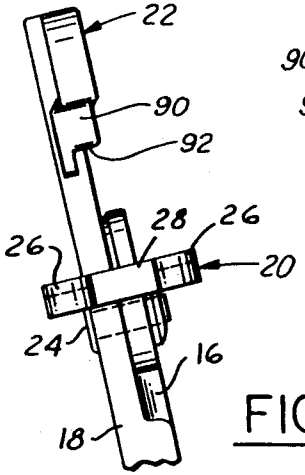
FIG. 6 is a fragmentary from elevational view of the hand tool of FIG. 5.

Upon the hand tool 10 being fully opened in FIG. 2 it is moved laterally such that the lower jaw central notch 30 is positioned to receive the shifter flange 44 therein wherein the pair of prongs 26 straddle the flange 44. The prongs 26 are positioned such that each of their aligned arcuate depressions 32 are brought into nested relation with an associated fore and aft cylindrical projecting portion 54 and 56 of the conduit fitting 52. It will be noted in FIGS. 5 and 6 that the upper jaw 22 is formed with a vertically disposed die member 90 having a right-angled cut-out defining a horizontal shoulder portion 92 and a coextensive vertical flank portion 94.

With reference to FIG. 4 it will be seen that upon initial closing of the hand tool 10 the die portion 90 is moved downwardly such that the shoulder 92 is placed in flush contact with the clip rib 86 such that its free edge 87 abuts the flank portion 94 as seen in FIG. 4. With the clip 70 captured between the reward face of the support flange 44 and the raised washer 88 closing of the pliers-like hand tool 10 causes the clip to be forced downwardly. The closing force causes the legs 78 to spring apart and enlarge the gap 82 whereby the clip moves downwardly allowing the central opening 74 to fit around the cable attaching cylindrical portion 54 between the raised washer 88 and the support flange 44.

While the principles of the invention in connection with the specific apparatus has been described, it is to be understood that the foregoing detailed description has been made by way of example only and not as a limitation to the scope of the invention as set forth in the accompanying claims.

What is claimed is:

1. In a pliers-like hand tool for securing a cable conduit fitting, having fore and aft cylindrical conduit portions, in a laterally extending open-ended slot of an attachment flange of a gear shift base by means of a U-shaped spring sheet steel clip, said clip having a substantially planar base formed with a central downwardly slotted semi-circular opening defining a pair of legs, said clip base upper portion formed with a rearwardly facing transversely extending right-angled flange, said clip semi-circular opening adapted for locking engagement on an annular notch of said fitting intermediate a raised washer on said conduit and an opposed face of said attachment flange, said hand tool having first and second lever members which cross over each other at a pivot, said first lever member having a lower jaw portion and a handle portion and said second lever member having an upper jaw portion and a handle portion with each said jaw and handle portion on either side of the pivot, the improvement in said jaw portions comprising:

said first lever member lower jaw portion in the form of a U-shaped anvil having a pair of horizontally disposed prongs defining a rectangular-shaped notch of predetermined width therebetween, each said prong formed with an upwardly facing arcuate concave depression therein, said depressions having their centers of curvature aligned on a common longitudinal axis, each said depression having a pre-determined radius of curvature adapted for seating an associated fore and aft fitting cylindrical conduit portion therein, such that each said conduit fore and aft portion having the principal axis thereof aligned on said common longitudinal axis;

said second lever member upper jaw portion in the form of an die member formed with a longitudinally extending downwardly facing right-angled cut-out, said cut-out defined by a flank portion and a shoulder portion intersecting at right angles such that with said flank portion oriented in a vertically disposed transversely extending plane the projection of which intersects said common longitudinal axis at a right angle;

with said cable conduit positioned in said attachment flange slot and said clip having its legs in initial press fit straddled relation on said fitting annular notch in flush contact with the aft face of said attachment flange, and with said upper and lower jaws open such that each said prong depression receives its associated fore and aft conduit portion therein, whereby with said cut-out flank and shoulder portions in gripping nested engagement with said clip right-angled bent flange such that upon squeezing said handle portions toward each other enabling said upper jaw to be initially moved downwardly toward said lower jaw, wherein the movement of said upper jaw downwardly to its closed position causing said clip to be forced downwardly with sufficient closing force enabling said clip central opening to be locked in a spring biased concentric manner on said fitting notch fixedly securing said cable fore and aft conduit fittings on said gear shift base.

* * * * *